US008511205B2

(12) United States Patent
Lee

(10) Patent No.: US 8,511,205 B2
(45) Date of Patent: Aug. 20, 2013

(54) OPENER

(75) Inventor: Dong Yool Lee, Gyeongsangnam-do (KR)

(73) Assignee: Dong Yool Lee, Gyeongsangnam-Do (KR)

( * ) Notice: Subject to any disclaimer, the term of this patent is extended or adjusted under 35 U.S.C. 154(b) by 40 days.

(21) Appl. No.: 13/132,003

(22) PCT Filed: Dec. 1, 2008

(86) PCT No.: PCT/KR2008/007093

§ 371 (c)(1),
(2), (4) Date: Jul. 15, 2011

(87) PCT Pub. No.: WO2010/064739

PCT Pub. Date: Jun. 10, 2010

(65) Prior Publication Data

US 2011/0259154 A1 Oct. 27, 2011

(51) Int. Cl.
*B67B 7/16* (2006.01)

(52) U.S. Cl.
USPC ..... 81/3.55; 81/3.57; 257/41

(58) Field of Classification Search
USPC ..... 81/3.55, 3.57; 254/120, 131, 131.5
See application file for complete search history.

(56) References Cited

U.S. PATENT DOCUMENTS

| | | | | | |
|---|---|---|---|---|---|
| 2,413,082 | A | * | 12/1946 | Skaer | 7/152 |
| 2,533,818 | A | * | 12/1950 | Krag | 81/3.55 |
| 3,542,231 | A | * | 11/1970 | Wettermann et al. | 215/226 |
| 3,905,101 | A | * | 9/1975 | Shepherd | 30/162 |
| 4,463,631 | A | * | 8/1984 | Barnes et al. | 81/3.09 |
| 4,646,440 | A | * | 3/1987 | Decker | 30/339 |
| 2006/0101947 | A1 | * | 5/2006 | Pratt | 81/3.57 |
| 2009/0078089 | A1 | * | 3/2009 | Newton | 81/3.57 |

FOREIGN PATENT DOCUMENTS

| | | | |
|---|---|---|---|
| JP | 02-016792 | U | 2/1990 |
| JP | 02-016793 | U | 2/1990 |
| KR | 10-1997-0015451 | A | 4/1997 |

OTHER PUBLICATIONS

International Search Report in International Application No. PCT/KR2008/007093, filed Dec. 1, 2008.

* cited by examiner

*Primary Examiner* — Monica Carter
*Assistant Examiner* — Melanie Alexander
(74) *Attorney, Agent, or Firm* — Saliwanchik, Lloyd & Eisenchenk

(57) ABSTRACT

Provided is a bottle opener. The bottle opener includes a handle, a body, a cap retaining portion, a force accumulation deforming portion, and a travel limiter. The handle is for a user to grasp. The body is installed on the handle. The cap retaining portion is formed on the body and contacts a side of a bottle cap. The force accumulation deforming portion is provided on the body and is elastically deformed by external pressure. The travel limiter is provided between the force accumulation deforming portion and the handle, and receives part of the force accumulation deforming portion to control a range of elastic deformation.

6 Claims, 3 Drawing Sheets

OPENER

CROSS-REFERENCE TO RELATED APPLICATION

This application is the U.S. national stage application of International Patent Application No. PCT/KR2008/007093, filed Dec. 1, 2008, the disclosure of which is incorporated herein by reference in its entirety.

TECHNICAL FIELD

The present disclosure relates to a bottle opener, and more particularly, to a bottle opener that generates a satisfying opening sound.

BACKGROUND ART

In general, a bottle opener employs the principle of a lever to enable opening of a sealed beverage cap using minimal exertion, and may be called an opener.

A bottle opener according to the related art has a metal body with a latch, that is integrated with a handle. The handle may have one of a wide assortment of shapes according to requirements, and is typically formed in a stick configuration to facilitate grasping by a user.

The latch is configured to latch between the central, upper surface of the bottle cap and an undersurface edge thereof, so that when the handle is lifted with the latch latched to the bottle cap, the central portion of the bottle cap is bent and the cap is opened as gas stored inside the bottle is discharged past the undersurface edge of the cap. Here, the discharged gas generates a "schlick" sound.

In a case where a bottle opener is not at hand, an experienced individual can readily use an everyday implement such as a spoon or a lighter as a substitute to open a bottle.

In the latter case, the individual holds the neck of the bottle just below the bottle cap with one hand and positions the implement to latch against the underside of the bottle cap just above the top of the grasping hand. In this state, when the individual applies sudden force using the lever principle, the bottle cap is opened as it generates a satisfying "pop" sound.

However, the above-described related art is accompanied by the following drawbacks.

When a bottle cap is opened using a related art bottle opener, the cap is bent as it is opened, and depending on the activated state of gas stored inside the bottle, a portion of the beverage stored with the gas can be sprayed outward in a certain direction.

Furthermore, the above-described technique of using one's hands and an implement to open a bottle cap is difficult to perform by unpracticed individuals, who may sustain injuries to their grasping hand from such endeavors.

DISCLOSURE OF INVENTION

Technical Problem

Embodiments provide a bottle opener that opens a bottle cap with the same mode of use as a conventional bottle opener, while generating a satisfying opening sound when opening the bottle cap.

Technical Solution

In one embodiment, a bottle opener includes: a handle for a user to grasp; a body installed on the handle; a cap retaining portion formed on the body and contacting a side of a bottle cap; a force accumulation deforming portion provided on the body and elastically deformed by external pressure; and a travel limiter provided between the force accumulation deforming portion and the handle, and receiving part of the force accumulation deforming portion to control a range of elastic deformation.

The cap retaining portion may contact a side at an upper end of the bottle cap, the force accumulation deforming portion may contact a side at a lower end of the bottle cap, and the force accumulation deforming portion may be elastically restored when an opening force exceeds a critical point of a sealing force of the bottle cap to accelerate an opening velocity to open the bottle cap.

The body may include a frame portion defining a framework thereof, and a reinforcing rib formed projecting to one side from a position along and inward apart from a periphery of the frame portion.

The travel limiter may include: a stopping portion integrally formed at a front of the handle; and a through-hole defined through the stopping portion, part of the force accumulation deforming portion passing through the through-hole, wherein the through-hole may be defined to be greater than a thickness of the force accumulation deforming portion to provide a space that accommodates upward/downward movement of the force accumulation deforming portion when the force accumulation deforming portion is deformed.

The travel limiter may include: a stopping portion defining a through-hole through which part of the force accumulation deforming portion is passed; and a projecting portion formed projecting at either side of the stopping portion, and interfering with a front end of the handle.

The bottle opener may further include a limiting projection on the body, to fix a position of the travel limiter.

The force accumulation deforming portion may progressively increase in width away from a part thereof contacting the bottle cap.

The bottle opener may further include a fastening hole and a fastening projection for facing and fastening to one another, one of the fastening hole and the fastening projection provided on the body and the other provided on the handle.

Advantageous Effects

In the present invention, the handle of a bottle opener is pivoted with the edge of a bottle cap held between a cap retaining portion and a force accumulation deforming portion. When the handle is pivoted, the bottle cap is abruptly opened by the restoring bias of the force accumulation deforming portion.

Accordingly, the gas sealed in the bottle is abruptly discharged when the bottle cap is opened to generate a satisfying opening sound and provide a refreshing sensation to the user.

Additionally, because the shape of the force accumulation deforming portion is laterally symmetrical and progressively increases in width from the front end rearward, and the range of elastic deformation is restricted by a travel limiter, stress is not concentrated on a certain region, thus improving durability. Further, reinforcing ribs are further formed along the edge of a frame portion to increase the strength of the bottle opener, extending the service life of the bottle opener and thus, raising user satisfaction with the product.

MODE FOR THE INVENTION

Reference will now be made in detail to the embodiments of the present invention, examples of which are illustrated in the accompanying drawings. It should be understood, however, that the technical spirit and scope of the present invention are not limited to the embodiments described below, and that those skilled in the art who understand the principles of the present invention will easily be able to devise other embodiments that will fall within the same spirit and scope of the present invention.

Figure 1:
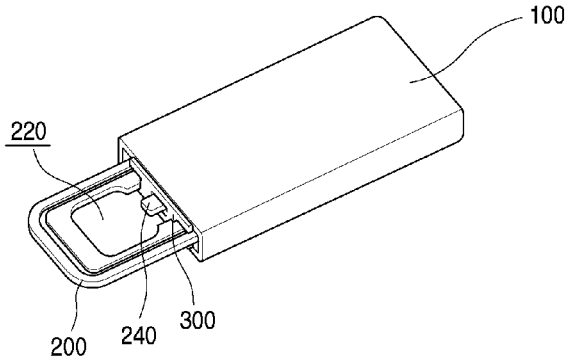
FIG. 1 is a perspective view of a bottle opener according to an embodiment of the present invention.
Figure 2:
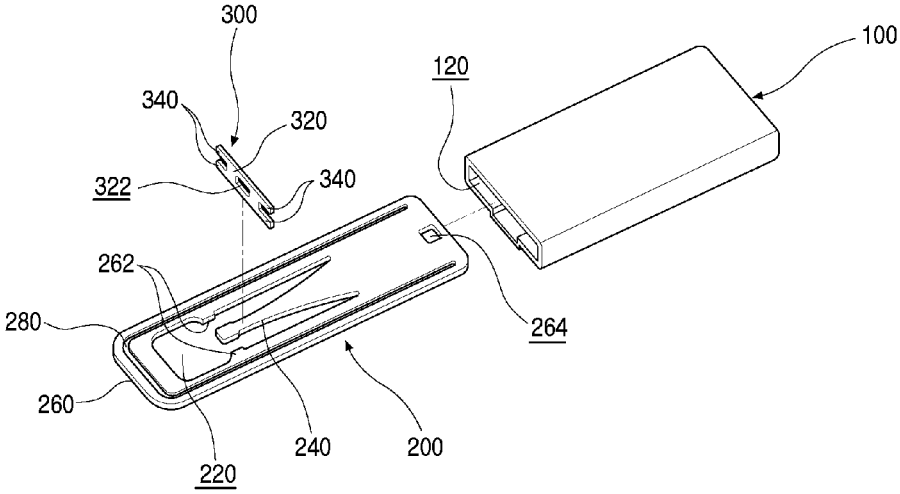
FIG. 2 is an exploded perspective view of a bottle opener according to an embodiment of the present invention.

FIG. 1 is a perspective view of a bottle opener according to an embodiment of the present invention, and FIG. 2 is an exploded perspective view of a bottle opener according to an embodiment of the present invention.

As shown in the diagrams, a bottle opener according to present embodiments includes a handle 100 formed in a roughly hexahedral shape for a user to grasp, a body 200 inserted and installed within the handle 100 and provided with cap retaining portion 220 on which a portion of a bottle cap (C) can be latched, and a travel limiter 300 that receives a portion of a force accumulation deforming portion 240 (to be described in detail below) to control the degree of elastic bias of the force accumulation deforming portion 240.

In detail, the handle 100 is formed in a hexahedral shape elongated in a horizontal direction, and an installing slot 120 is defined hollow within to accommodate the body 200 inserted therein.

Also, while not shown in FIGS. 1 and 2, a fastening projection 182 (in FIG. 182) may be formed inside the hollow handle 100 to project inward, in order to be inserted and installed in a fastening hole 264 defined in the body 200.

A metal frame portion 260 defines the structure of the body 200. Also, a reinforcing rib 280 may be formed slightly apart from and inward of the periphery of the frame portion 260.

The reinforcing rib 280 is formed to have a predetermined width and project downward from the top surface of the frame portion 260, and is integrally formed with the frame portion 260 to define a uniform passage along the frame portion 260 except for at the upper rear edge surface of the frame portion 260.

Of course, while it is possible to form the reinforcing rib 280 along the upper rear edge surface of the frame portion 260 as well, it may be omitted from the rear edge because the latter is not subject to high pressure loads.

A cap retaining portion 220 of a shape corresponding to the shape of a bottle cap (C) is defined in the front, central portion of the frame portion 260 to retain one end at the top of a bottle cap (C).

Also, the end of a force accumulation deforming portion 240 is disposed to the rear of the cap retaining portion 220 to contact one end at the lower side of the bottle cap (C).

In further detail, the cap retaining portion 220 is defined so that its opening at the rear is slightly narrower than the diameter of the bottle cap (C).

The end of the force accumulation deforming portion 240 is disposed at the rear open end of the cap retaining portion 220, as described above. That is, the force accumulation deforming portion 240 is formed extending from the rear part of the frame portion 260 to the rear open end of the cap retaining portion 220, and becomes progressively wider from its front end toward the rear, as shown in FIG. 2.

This shape, in consideration of the elasticity and strength of the force accumulation deforming portion 260, is to prevent stress from being concentrated on only one part of the force accumulation deforming portion 260, and may be provided in various other shapes than that shown, according to the characteristics of the material used.

A limiting projection 262 is further formed on the frame portion 260 to project inward to either side at the front of the force accumulation deformation portion 240.

The limiting projections 262 are for preventing the above-described travel limiter 300 from disengaging forward when the latter receives a portion of the force accumulation deforming portion 240, and for this purpose, the limiting projections 262 are formed to project and define predetermined gaps with the end of the force accumulation deforming portion 240. The configuration of the travel limiter 300 and its fastening with the body 200 will be described in detail below with reference to the diagrams.

Figure 3:
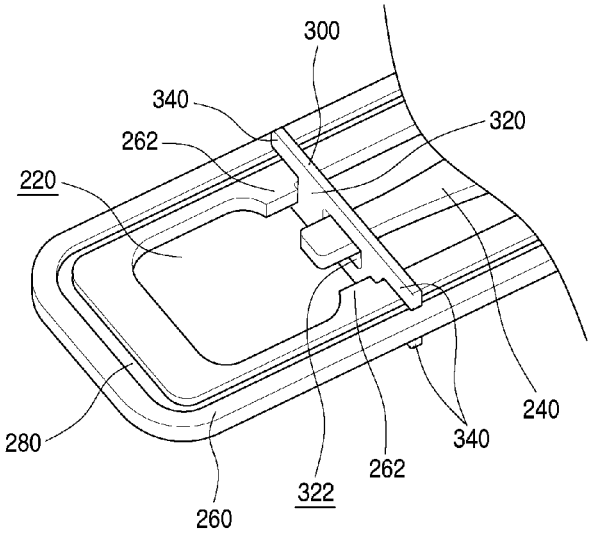
FIGS. 3 and 4 are upper and lower perspective views of a travel limiter, that is the principle component of the present invention.
Figure 4:
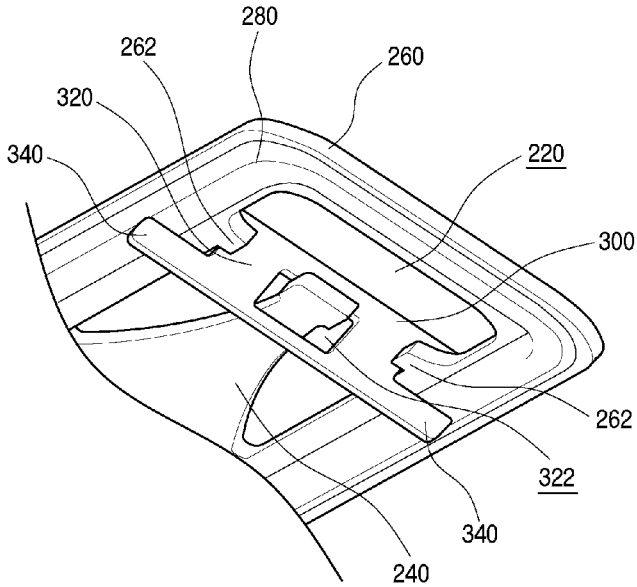

FIGS. 3 and 4 are upper and lower perspective views of a travel limiter, that is the principle component of the present invention.

As shown, the travel limiter 300 is a plate material formed roughly in a vertically prone "H" shape.

A stopping portion is formed at the central part of the travel limiter 300 to interfere with the limiting projections 262, and defines a through-hole 322 through which a portion of the force accumulation deforming portion 240 can pass.

The through-hole 322 is formed larger than the width of the force accumulation deforming portion 240 to provide a space allowing upward/downward play of the force accumulation deforming portion 240 when the latter is pressed by an opening force.

Projecting portions 340 are formed projecting outward at either lateral end of the stopping portion 320, and the projecting portions 340 contact the front end of the handle 100 to prevent it from being pushed rearward.

For this, the projecting portions 340 may be formed of a size to adequately contact the front end of the handle 100, or may be formed of a thickness corresponding to the thickness at the front of the handle 100, in consideration of external appearance.

A travel limiter 300 configured as above may have one side angled and inserted in the space defined between the front of the force accumulation deforming portion 240 and the limiting projection 262, after which a portion of the force accumulation deforming portion 240 may be inserted through the through-hole 322 provided in the center of the stopping portion 320.

Then, the other side may be inserted to align with the first inserted side, and the front surface of the stopping portion 320 may be disposed behind the limiting projections 262, thus completing installation.

When installation of the above travel limiter 300 is completed, the handle 100 is inserted over and mounted on the body 200.

Specifically, the body 200 is pushed—rear first—into the installing slot 120 defined in the front end of the handle 100, the fastening projection 182 (in FIG. 5) provided within the handle 100 is inserted and installed in the fastening hole 264, and the front of the handle 100 contacts the rear surface of the travel limiter 300 to complete assembly of the bottle opener.

The travel limiter 300 may be integrally formed with the handle 100.

Figure 5:
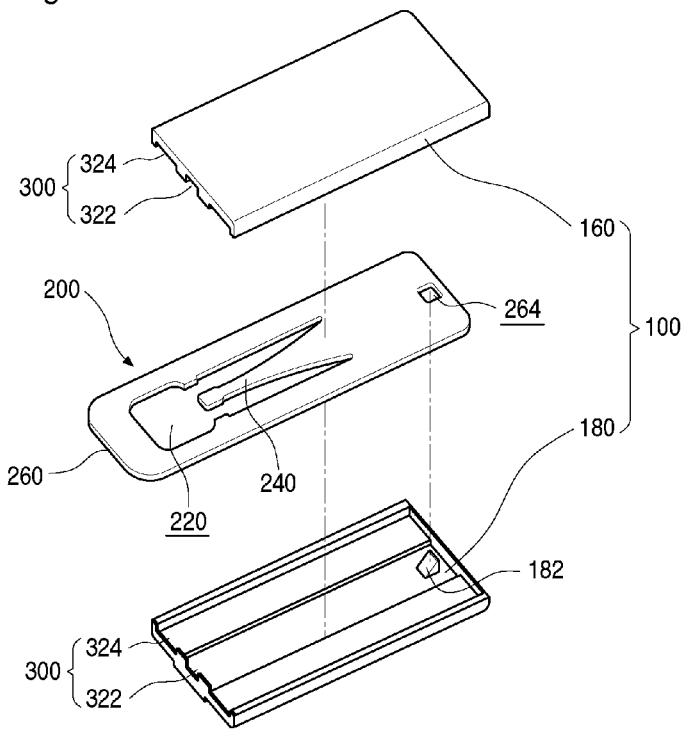
FIG. 5 is an exploded perspective view of a bottle opener according to another embodiment of the present invention.

FIG. 5 is an exploded perspective view of a bottle opener according to another embodiment of the present invention.

As shown, in another embodiment of the present invention, the handle 100 is configured with a separate upper portion 160 and lower portion 180.

Also, with the fronts of the upper portion 160 and the lower portion 180 of the handle 100 shape-coupled to define the through-hole 322 through which a portion of the force accumulation deforming portion 240 is passed (as described in the former embodiment), a space is also defined in which a part of the frame portion 260 is received.

That is, the upper portion 160 and lower portion 180 of the above-configured handle 100 has the body 200 received and fastened therein. Here, the fastening projection 182 formed on the lower portion 180 of the handle 100 is inserted and installed in the fastening hole 264 of the body 200.

The fastening projection 182, may be formed on a lower portion 180 of the handle 100 (as shown), or may be formed on the body 200.

Of course, if the fastening projection 182 is formed on the body 200, the fastening hole 264 may be defined in an upper portion 160 or the lower portion 180 of the handle 100.

As described above, if the handle 100 and the body 200 are fastened by the fastening projection 182 and the fastening hole 264, the upper portion 160 and lower portion 180 of the handle 100 may be thermally fused, may be coupled using a fastening member, etc.

A description will be provided below on the function of a bottle opener according to the present invention, having the above-described configuration and assembly method.

Figure 6:
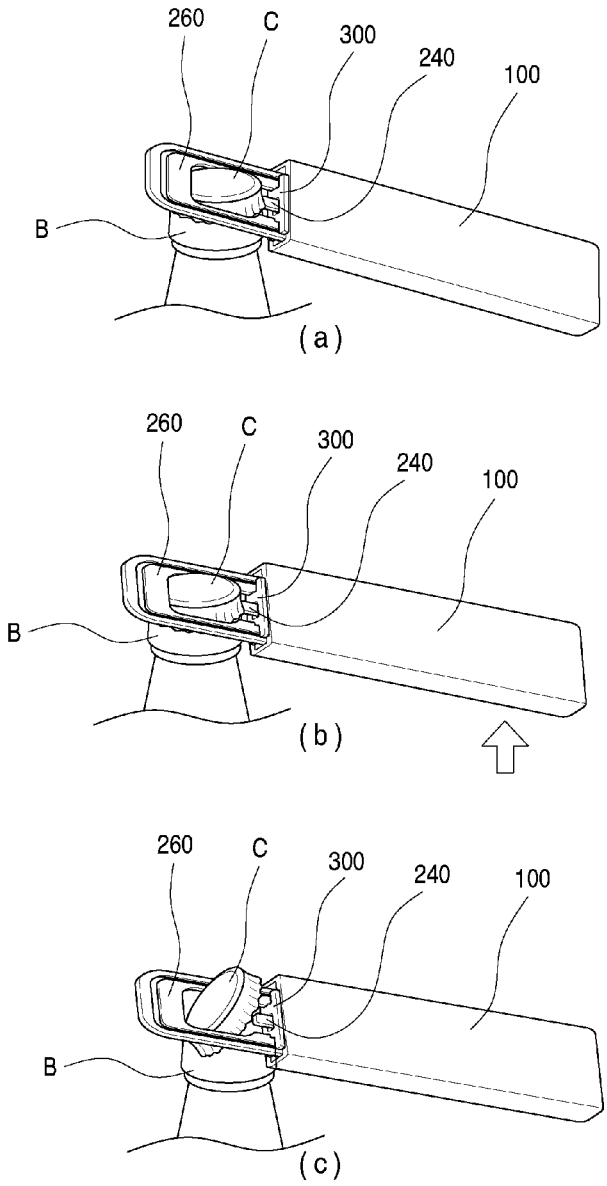
FIG. 6 is a perspective view showing exemplary use of a bottle opener according to the present invention.

FIG. 6 is a perspective view showing exemplary use of a bottle opener according to the present invention.

As shown, in order to open a beverage bottle (B) using a bottle opener according to the present invention, first, the upper end of the cap retaining portion 220 is positioned to contact the upper edge at one side of the bottle cap (C) sealing the beverage bottle (B).

Then, the end of the force accumulation deforming portion 240 is positioned to contact the bottom edge of the bottle cap (C) directly in-line with the upper end of the cap retaining portion 220.

In this state, a user grasps the beverage bottle (B) with one hand and grasps the handle 100 with the other hand, and then raises the grasped handle 100.

Here, the handle 100 is easily pivoted upward until the point where elastic deformation from elastic bias of the force accumulation deforming portion 240 is imparted. Then, the lower surface of the force accumulation deforming portion 240 increases the amount of force required to pivot the handle 100 as it contacts an edge defining the through-hole 322.

Specifically, as shown in FIG. 6(*b*), the elastic deformation range of the force accumulation deforming portion 240 is restricted and elastic restoring force is accumulated by the travel limiter 300 that is positionally retained by the limiting projections 262 and the front end of the handle 100, and when the critical point of the sealing force of the bottle cap (C) is reached, the accumulated restoring force accelerates the speed at which the bottle cap (C) is pushed up to negate the fastened state between the bottle cap (C) and the beverage bottle (B).

The bottle cap (C) that has been unfastened as above is accelerated in its opening speed by the restoring force accumulated in the force accumulation deforming portion 240, so that gas sealed inside the beverage bottle (B) is abruptly discharged, generating a satisfying opening "pop" sound.

In addition, because the cap retaining portion 220 and the force accumulation deforming portion 240 contact the edges of the bottle cap (C) to open the bottle cap (C), the round shape of the bottle cap (C) remains virtually unchanged.

The invention claimed is:

1. A bottle opener comprising:

a handle for a user to grasp;

a body installed on the handle;

a cap retaining portion formed on the body and contacting a side of a bottle cap;

a force accumulation deforming portion provided on the body and elastically deformed by external pressure; and a travel limiter provided between the force accumulation deforming portion and the handle, and receiving a portion of the force accumulation deforming portion to control a range of elastic deformation, wherein the travel limiter comprises:

a stopping portion defining a through-hole through which part of the force accumulation deforming portion is passed; and a projecting portion formed projecting at either side of the stopping portion, and interfering with a front end of the handle, wherein the through-hole is larger than the width of the force accumulation deforming portion to provide a space allowing for upward and downward movement of the force accumulation deforming portion when the force accumulation deforming portion is pressed by an opening force.

2. The bottle opener according to claim 1, wherein the cap retaining portion contacts a side at an upper end of the bottle cap, the force accumulation deforming portion contacts a side at a lower end of the bottle cap, and the force accumulation deforming portion is elastically restored when an opening force exceeds a critical point of a sealing force of the bottle cap to accelerate an opening velocity to open the bottle cap.

3. The bottle opener according to claim 1, wherein the travel limiter comprises:

a stopping portion integrally formed at a front of the handle; and a through-hole defined through the stopping portion, part of the force accumulation deforming portion passing through the through-hole, wherein the through-hole is defined to be greater than a thickness of the force accumulation deforming portion to provide a space that accommodates upward/downward movement of the force accumulation deforming portion when the force accumulation deforming portion is deformed.

4. The bottle opener according to claim 1, further comprising a limiting projection on the body, to fix a position of the travel limiter.

5. The bottle opener according to claim 1, wherein the force accumulation deforming portion progressively increases in width away from a part thereof contacting the bottle cap.

6. The bottle opener according to claim 1, further comprising a fastening hole and a fastening projection for facing and fastening to one another, one of the fastening hole and the fastening projection provided on the body and the other provided on the handle.

* * * * *